US005850753A

United States Patent [19]

Varma

[11] Patent Number: 5,850,753

[45] Date of Patent: Dec. 22, 1998

[54] CODE-OPERATED CATCH MECHANISM FOR HOTEL ROOM DOOR

[76] Inventor: Shivendra Varma, 2 McFadden Drive, Brampton, Ontario, Canada, L6Z 3H4

[21] Appl. No.: 541,198

[22] Filed: Oct. 16, 1995

Related U.S. Application Data

[63] Continuation-in-part of Ser. No. 172,251, Dec. 23, 1993, abandoned.

[51] Int. Cl.[6] ..... E05B 49/00

[52] U.S. Cl. ..... 70/278; 340/825.31; 292/341.16; 292/341.18

[58] Field of Search ..... 292/341.16, 341.17, 292/92, 341.18; 70/278, 279, 108, 92; 340/825.31

[56] References Cited

U.S. PATENT DOCUMENTS

| | | | |
|---|---|---|---|
| 3,242,706 | 3/1966 | Check | 70/110 |
| 3,336,775 | 8/1967 | Russell et al. | 70/110 |
| 3,910,617 | 10/1975 | Scalza et al. | 292/341.16 |
| 4,099,758 | 7/1978 | Yamamoto et al. | 292/341.18 |
| 4,551,832 | 11/1985 | Carll et al. | 370/58 |
| 4,595,220 | 6/1986 | Manchett, Jr. et al. | 292/341.17 |
| 4,644,104 | 2/1987 | Middlemiss | 70/269 |
| 4,672,826 | 6/1987 | Mombelli | 70/278 |
| 4,721,954 | 1/1988 | Mauch | 340/825.31 |
| 4,760,393 | 7/1988 | Mauch | 340/825.31 |
| 4,763,937 | 8/1988 | Sittnick, Jr. et al. | 292/92 |
| 4,824,151 | 4/1989 | Taylor | 292/341.16 |
| 4,867,496 | 9/1989 | Thomas | 292/341.18 |
| 4,929,003 | 5/1990 | McConnell | 292/144 |
| 5,171,050 | 12/1992 | Mascotte | 292/341.18 |
| 5,195,792 | 3/1993 | Stendel | 292/341.16 |
| 5,204,663 | 4/1993 | Lee | 340/825.34 |
| 5,219,196 | 6/1993 | Luker | 292/341.16 |
| 5,474,342 | 12/1995 | Smith et al. | 292/341.16 |
| 5,476,221 | 12/1995 | Seymour | 236/47 |
| 5,490,699 | 2/1996 | Uyeda | 292/341.16 |

FOREIGN PATENT DOCUMENTS

| | | | |
|---|---|---|---|
| 1053291 | 4/1979 | Canada | 292/341.18 |
| 2467946 | 5/1981 | France | 70/263 |
| 2649151 | 1/1991 | France . | |
| 2651268 | 3/1991 | France | 70/273 |
| 9006024 | 5/1990 | WIPO | 70/276 |

*Primary Examiner*—Darnell M. Boucher
*Attorney, Agent, or Firm*—Mirek A. Waraksa

[57] ABSTRACT

A controllable catch mechanism is installed in the door frame of hotel room to engage both a spring-biased latch and a deadbolt associated with the room door. The position of the deadbolt is sensed or a requirement for privacy is otherwise indicated with a switch within the room. An alphanumeric keyboard external to the room allows entry of access codes. If an authorized guest code is entered, a microprocessor-based controller unlocks the catch mechanism regardless of the privacy requirement. The guest code can be changed by the guest, as desired. If a cleaner enters a universal access code, the controller unlocks the catch mechanism only if the bolt is unlocked or no privacy requirement is indicated. Special override codes are provided that unlock the catch mechanism regardless whether the bolt is locked, permitting security staff to handle emergencies. A panic switch within the room causes an alarm signal to be generated and simultaneously releases the catch mechanism to allow security staff or passers-by to intervene. The operation of an HVAC unit and other equipment such as a telephone and television set are controlled in response to access codes.

14 Claims, 14 Drawing Sheets

CODE-OPERATED CATCH MECHANISM FOR HOTEL ROOM DOOR

CROSS-REFERENCE TO RELATED APPLICATION

This is a continuation-in-part of U.S. patent application Ser. No. 172,251, filed on Dec. 23, 1993, now abandoned.

FIELD OF THE INVENTION

The invention relates to apparatus for controlling access to rooms within a building such as a hotel.

DESCRIPTION OF THE PRIOR ART

Guest security is a major concern in the hotel industry. Lost or duplicated keys potentially permit unauthorized access to a hotel room. Hotel operators have thus been replacing key-operated latch mechanism with latch mechanisms controlled by magnetic card readers. A magnetic card reader is mounted directly to the door of a hotel room, and the key-operated spring-biased latch that normally locks the door is replaced with a latch that releases in response to operation of the card reader. The card reader may respond to several stored codes. Cleaning staff normally have cards with universal access codes that permit entry into several rooms. A guest will normally receive a card bearing an access code unique to his room. The guest's code is typically assigned by a computer at the front desk of the hotel upon registration.

Steps are taken to ensure that a departing guest or someone who has obtained his card cannot afterwards access the room. After a guest's departure, hotel cleaning staff trigger the card reader to change the guest access code, and the card reader then updates the access code according to a predetermined algorithm. The computer at the front desk of the hotel normally stores all guest access codes and uses the same algorithm as the card readers to update guest access codes. This allows the front desk to provide an appropriately encoded card to the next guest assigned the particular room.

There are several shortcomings to such practices. Nowadays most hotel room doors have a deadbolt. The deadbolt mechanism is operated solely with an actuator mounted on the door within the room. This not only gives a guest a measure of security but also prevents entry of cleaning staff at inappropriate times, a persistent problem in the hotel industry. However, if the occupant of the room has a mishap and the deadbolt has been locked, there is no convenient way to open the door. If an intruder enters the room, he can set the deadbolt, frustrating intervention by hotel security staff. Another problem is that the updating of guest codes at the card readers and the front desk are normally separate operations. The front desk must typically be notified by cleaning staff when a card reader has been operated to update a guest access code to ensure that the front desk computer properly tracks all currently authorized codes. Other problems relate to the magnetic cards themselves. They are easily damaged, erased or lost. Duplicate cards can be issued to non-authorized parties.

BRIEF SUMMARY OF THE INVENTION

In one aspect, the invention provides apparatus for controlling access to a room. A door associated with the room may carry both a latch mechanism and a deadbolt mechanism. The latch of the latch mechanism is normally urged by a spring to locate in a locking position within the frame surrounding the door. The deadbolt mechanism has a bolt that must be manually displaced to a locking position within the frame. The apparatus comprises catch means that mount within the frame to receive the latch when advanced to its locking position. The catch means have a locking state in which the received latch is engaged to prevent the door from opening and an unlocking state in which the received latch displaces with the door to allow the door to open. Manually operable means are provided to permit an occupant of the room to set a condition indicating a request for privacy. The setting means may consist of the deadbolt mechanism together with a sensor that detects whether the bolt is in its locking position, the throwing of the deadbolt constituting the condition indicating a request for privacy. The setting means may alternatively be a switch that allows setting and resetting of the condition, which may be a latched signal or a continuing state of the control means, in which case the control means are preferably adapted to sense the state of the door and to automatically reset (null) the condition when the door is opened thereby ensuring the condition does not continue if the room is unoccupied. Control means are provided to control the state of the catch means in response to the condition and in response to access codes. The control means include input means that can be mounted external to the room, as on the wall in which the frame is installed, to allow receipt of codes. Although the input means in this aspect of the invention may be a card reader, a keyboard is preferred in order to eliminate cards and also implement other aspects of the invention. The control means are programmed to respond to at least one access code by placing the catch means in the unlocking state regardless whether the condition is set and to respond to at least one other access code by placing the catch means in the unlocking state only if the condition is not set.

In typical hotel applications, cleaning staff may be assigned access codes that cannot unlock the catch means if a condition indicating a privacy requirement has been set. This reduces the risk that cleaning staff will intrude upon guests. Other access codes that effectively override privacy requirements may be assigned to hotel security staff and may be assigned to a guest so that all members of his party continue to have access to the room. In a preferred implementation, the catch means are adapted to receive and engage both the latch and the deadbolt in the locking state and to allow both the latch and deadbolt to displace with the door in the unlocking state. This ensures that hotel security staff who have been assigned high-priority access codes can access the room in the event of an emergency even if the deadbolt has been set.

In another aspect, the catch means may be adapted to permit convenient retrofitting of doors for access control, particularly conventional hotel room doors. Many latch mechanisms associated with hotel room doors have a security pin which is urged to extend toward the frame surrounding the door. Retraction of the latch is disabled whenever the security pin is pushed toward the door, and a credit card or other thin tool inserted between the door and frame in an attempt to retract the latch will normally cause retraction of the security pin. The spacing between the latch and deadbolt may vary considerably between sites but such variations can be readily accommodated by providing a large opening in the catch means. Variations in the position of the security pin relative to both the latch and bolt are more difficult to accommodate. Providing a custom-made face or striking plate to receive the latch and bolt but stop the security pin is an immediate but still costly solution. To that end, the catch means may be provided with a housing having an opening for receiving the latch and bolt. A stop is provided for engagement with the security pin, and means are provided to secure the stop to the housing at various selectable positions in which the stop extends into the opening thereby accommodating variations in the position of the pin.

Other aspects of the invention address various problems that the hotel industry has experienced. These aspects of the invention include pre-assignment of access codes to guests to avoid line-ups at reception desks and subsequent changing of guest access codes by the guests themselves to enhance security or to substitute codes more easily remembered by guests. Entry of access codes may be used to control operation of equipment within a hotel room. For example, the control means may comprise a switch controlling operation of a telephone or television set within the room, and may be programmed to enable and disable operation in response to entered access codes. Thus, the telephone or television may be disabled if an access code assigned cleaning staff is entered, encouraging cleaning staff to perform their functions, but enabled if a guest access code is entered. The operation of equipment affecting the temperature of the room may be similarly controlled. It is known to adapt an HVAC (heating, ventilating and air conditioning unit) to have an energy-conserving mode of operation in which energy-efficient room temperatures are maintained and a user-preference mode of operation responsive to user-set temperature settings, to detect presence and absence of a person in the room with an appropriate sensor, and to switch operating modes accordingly. The control means of the present invention may be programmed to respond at least in part to receipt of a predetermined access code (typically assigned to a guest) by setting the equipment to its user-preference mode of operation and to respond to receipt of another access code (assigned for example to cleaning staff) to leave the equipment in its current operating mode, which will typically be the energy-conserving mode, even though someone is in the room.

Various aspects of the invention will be apparent from a description below of preferred embodiments and will be more specifically defined in the appended claims.

DESCRIPTION OF THE DRAWINGS

The invention will be better understood with reference to drawings in which.

DESCRIPTION OF PREFERRED EMBODIMENTS

Figure 1:
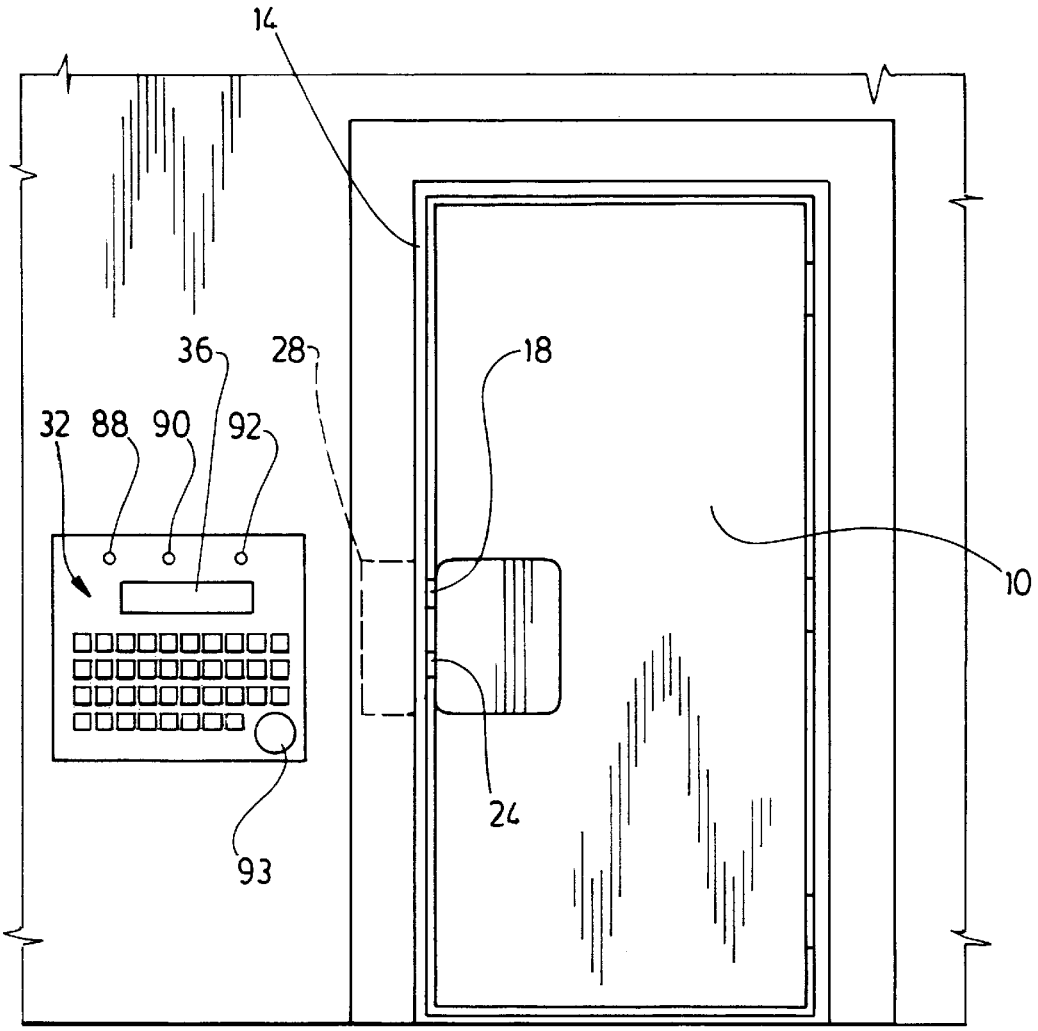
FIG. 1 is a diagrammatic elevational view showing a door accessing a hotel room and showing parts of an access control system.
Figure 2:
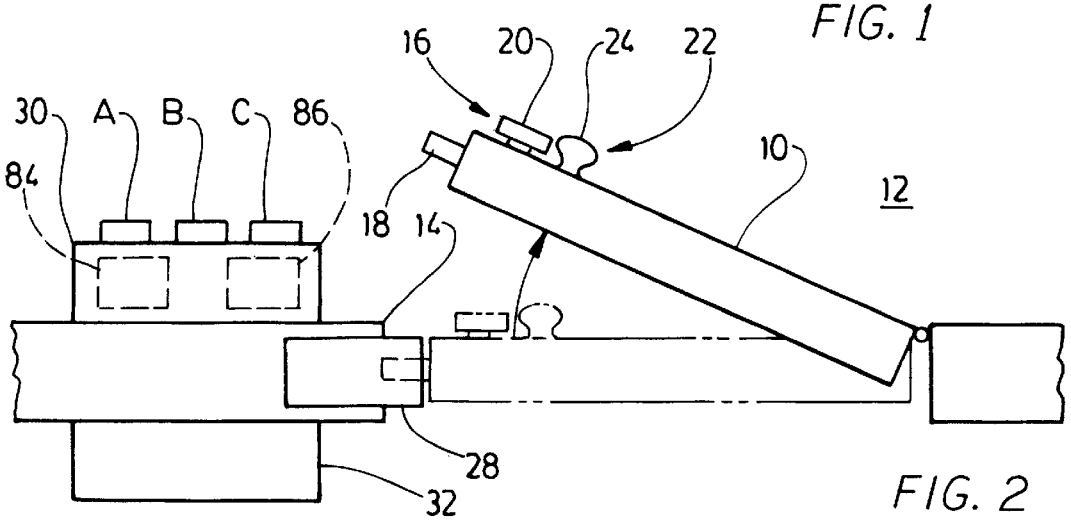
FIG. 2 is a diagrammatic plan view from above of the door and certain lock mechanisms and controls associated with the door.

An overview of a preferred embodiment of the invention will be provided with references to FIGS. 1 and 2. These views show a door 10 accessing a room 12 within a hotel. The door 10 pivots on a wall-mounted frame 14. It has a closed position with the frame 14 as shown in phantom outline in FIG. 2 and an open position within the room 12 as shown in solid outline in FIG. 2. The door 10 carries a conventional spring-biased latch mechanism 16. Its latch 18 is operated with a doorknob 20 within the room 12. No external actuator for the latch mechanism 16 is provided. The door 10 also carries a conventional deadbolt mechanism 22 whose bolt 24 is operated with a conventional actuator 26 within the room 12. A catch mechanism 28 is mounted within the frame 14 to receive the latch 18 and bolt 24 and operates on the received latch 18 and bolt 24 to control access to the room 12. A controller 30 mounted on a wall within the room 12 controls the locking state of the catch mechanism 28. The controller 30 is associated with an alphanumeric keyboard 32 that includes a liquid crystal display 36. The keyboard 32 is mounted on a wall in a hallway external to the room 12 and is positioned proximate to the door 10.

The latch 18 and bolt 24 displace within the door 10 along parallel horizontal axes (not illustrated). Both are shown in locking positions within the door frame 14 in FIGS. 1 and 5. The latch 18 is located within a compartment formed in an edge of the door 10, as apparent in FIG. 8. It can be retracted to an unlocking position clear of the frame 14 and entirely within the door 10 by turning the internal doorknob 20. It is urged by a coil spring 38 to its locking orientation when the doorknob 20 is released. The bolt 24 also has an unlocking orientation entirely within the door 10. The bolt 24 displaces between its locking and unlocking orientations only in response to manual operation of the associated actuator 26.

The catch mechanism 28 includes a steel housing 40. The housing 40 is dimensioned to be inset into the frame 14 and adjoining wall to which the frame 14 is mounted. The housing 40 has detachable face and side plates 42, 44 that are shown and specifically indicated in FIG. 2. The face plate 42 has rectangular openings (not illustrated) dimensioned and spaced to receive the latch 18 and bolt 24. It cooperates with a spring-biased pin of the latch mechanism 16 that is intended to prevent the latch 18 from being defeated, as with a conventional credit card. The side plate 44 presents a lateral opening 48 which allows parts of the catch mechanism 28 to deflect relative to the housing 40, as discussed more fully below.

Figure 3:
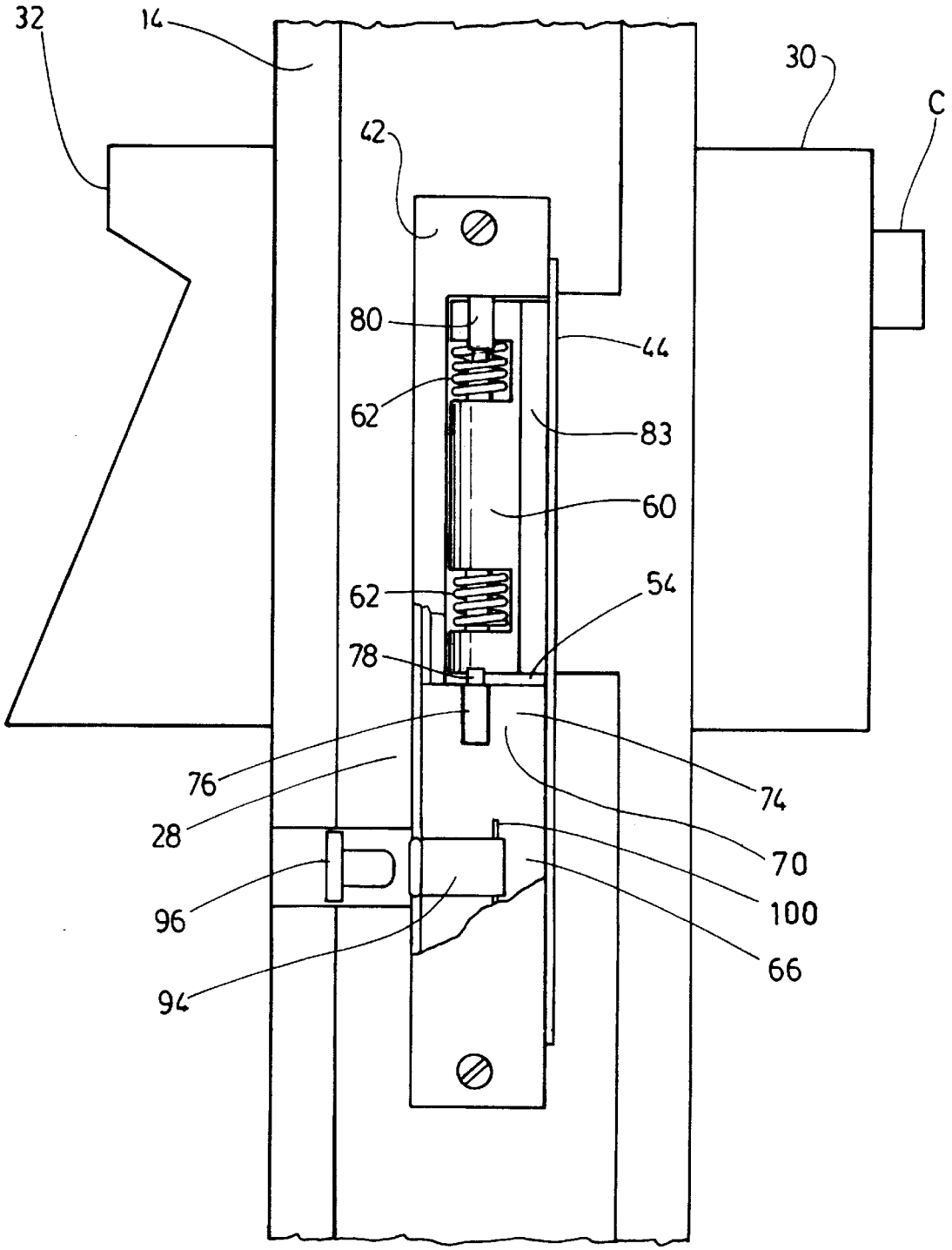
FIG. 3 is a side elevation showing a catch mechanism mounted within a door frame.

The housing 40 contains a catch assembly that engages the latch 18 and bolt 24 in their locking positions. Most components of the catch assembly are apparent in FIGS. 5 and 6. The catch assembly includes a steel support 50 bolted to the housing 40. The support 50 comprises a side plate 52, parallel upper and lower arms 54 fixed to the side plate 52 and a rear plate 56 perpendicular to the side plate 52. The upper and lower arms 54 are apertured to receive a vertical pivot pin 58 whose lower end is secured with a clip 59 (indicated in FIG. 6). An L-shaped catch 60 has a lengthwise opening that receives the pin 58 thereby orienting the catch 60 for pivoting displacement between a locking position (shown in FIG. 6) and an unlocking position (substantially as shown in phantom outline in FIG. 4 and solid outline in FIG. 8). The latch 18 and bolt 24 are received between the catch 60 and the side plate 52 of the support 50 when the door 10 is closed and the latch 18 and bolt 24 are advanced to their locking positions. Two coil springs 62 (both apparent in FIG. 3) mounted about the pin 58 urge the catch 60 towards its locking position, which is the normal rest position of the catch 60. A stop mechanism 64 normally secures the catch 60 in its locking position. In such a locking state, the catch 60 engages the latch 18 and bolt 24 to prevent the door 10 from pivoting to its open orientation within the room 12. When released by the stop mechanism 64, the latch 18 and bolt 24 pivot with the door 10 into the room 12. The catch 60 is simply deflected by the latch 18 and bolt 24 to its unlocking position. It should be noted that no doorknob is required on the exterior of the door 10. When the catch mechanism 28 is in its unlocking state, the door 10 can simply be pushed open from the hallway. If the bolt 24 is not set, the door 10 can be opened from within the room 12 by turning the doorknob 20 to draw the latch 18 to its unlocking position within the door 10.

Figure 5:
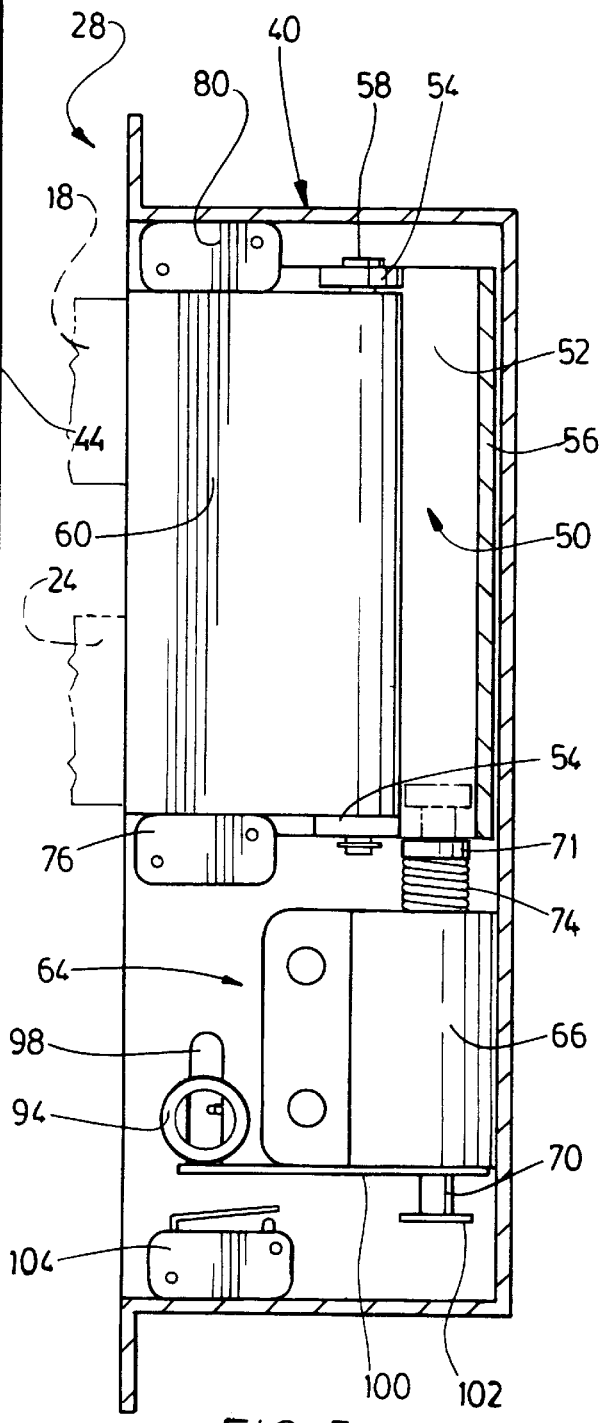
FIG. 5 is a side elevational view of the catch mechanism with the side plate and a face plate removed.
Figure 6:
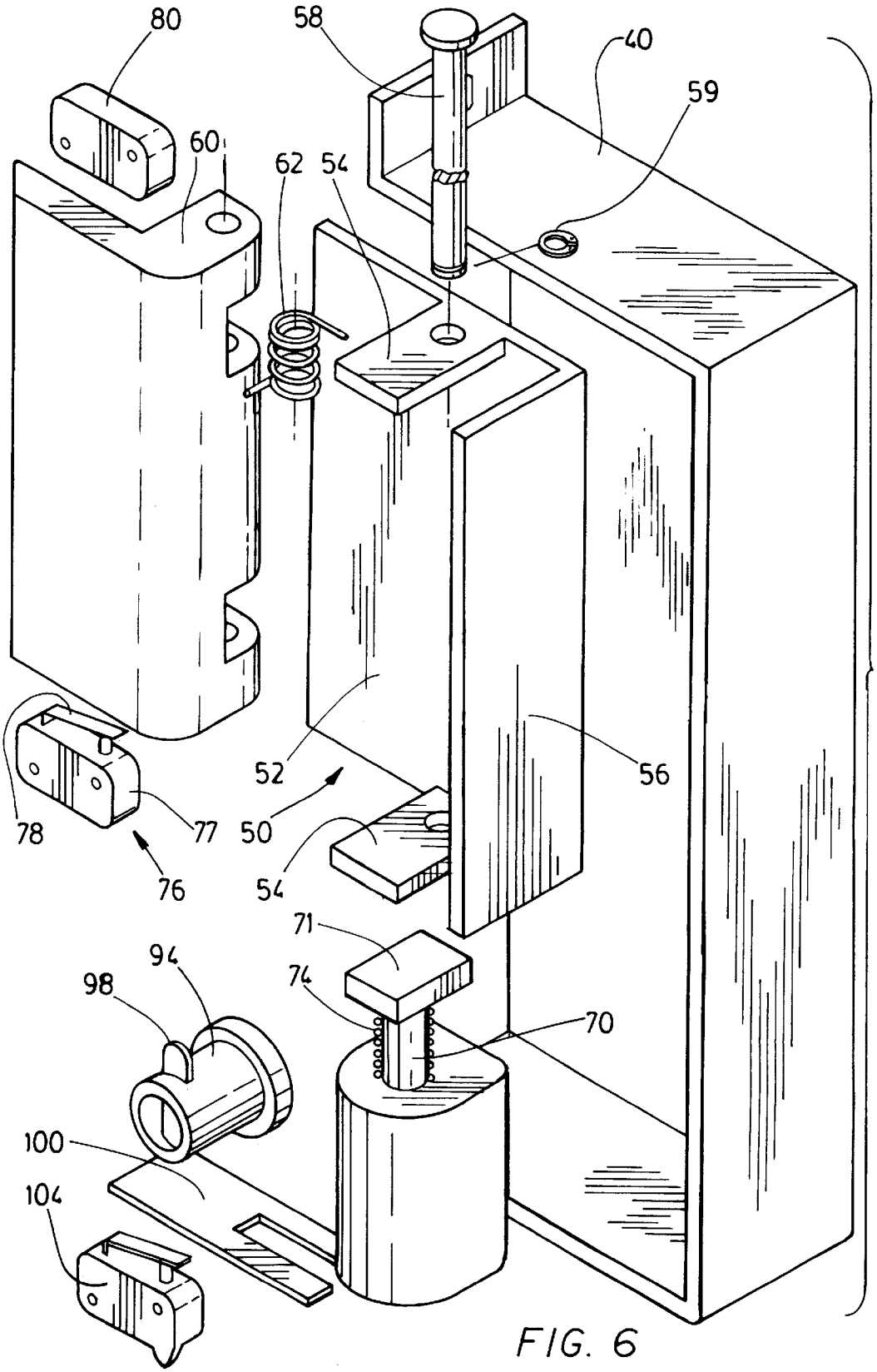
FIG. 6 is an exploded perspective view of the catch mechanism without the side plate and face plate.

Components of the stop mechanism 64 are most apparent in FIGS. 5 and 6. The stop mechanism 64 includes a solenoid 66 fixed to the housing 40 below the catch 60 and its support 50. The solenoid 66 has a vertical shaft 70 whose upper end is terminated with a rectangular stop 71. The stop 71 has an upper locking position shown in phantom outline in FIG. 5 in which it engages a rear surface of the catch 60 to prevent pivoting of the catch 60 to its unlocking position. It has a lower unlocking position shown solid in FIG. 5 in which the stop 71 is located below and clear of the catch 60 to allow the catch 60 to deflect in response to pivoting of the door 10 inwardly. A coil spring 74 mounted on the shaft 70 urges the stop 71 upwardly to its locking position. The solenoid 66 is electrically actuated to lower the stop 71 to its unlocking position.

A switch 76 (shown in FIGS. 3, 5 and 6) is used to indicate the position of the bolt 24. The switch 76 is fixed to the bottom of the side plate 52 of the support 50. It has a button 77 which closes the switch 76 and which is spring-biased to open the switch 76. An arm 78 overhangs the button 77 and extends upwardly into the path of the bolt 24. The arm 78 is inherently spring-biased to separate from the button 77. When the bolt 24 is advanced to its locking orientation, it deflects the arm 78 downwardly, depressing the button 77 and closing the switch 76. When the bolt 24 is retracted to its unlocking position, the switch 76 automatically reverts to its open state. A similar switch 80 is located above the catch 60 in an inverted orientation. It is intended for use in installations in which the vertical positions of the latch 18 and the bolt 24 are interchanged. It is not operative in the implementation shown. If the vertical positions of the latch 18 and the bolt 24 were interchanged on a particular door, the switch 80 would perform the function now performed by the switch 76 and the switch 76 would be effectively disabled.

Figure 4:
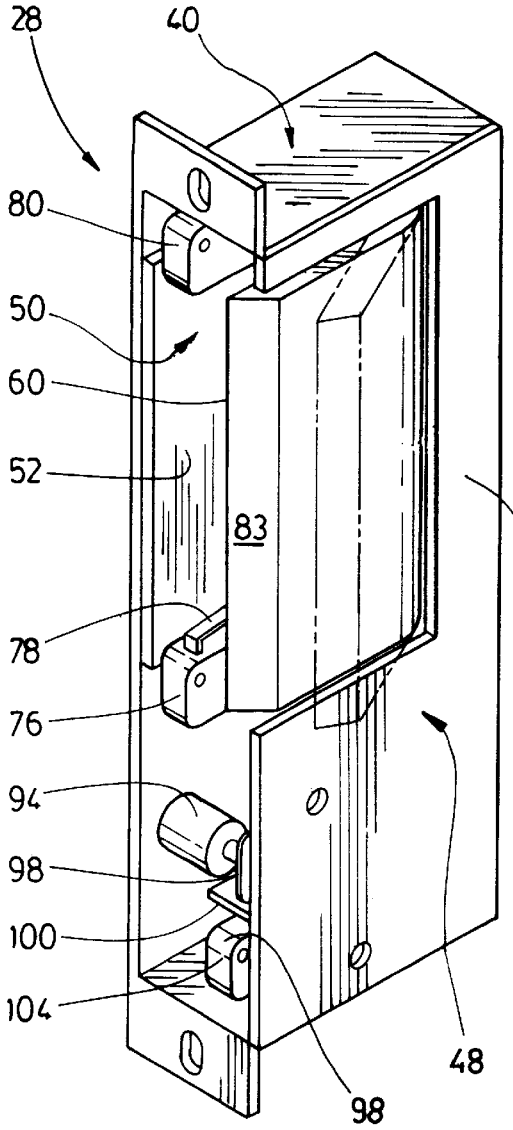
FIG. 4 is a perspective view of the catch mechanism.
Figure 7:
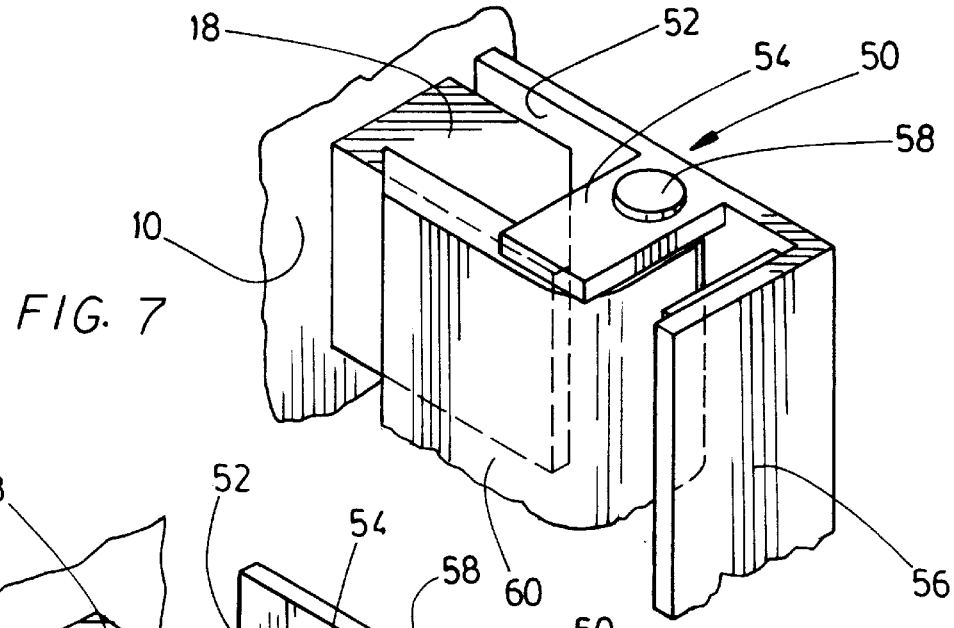
FIGS. 7–9 are fragmented perspective views showing how a latch cooperates with the catch mechanism as the door is opened and closed; and, FIG. 10 schematically illustrates how controls associated with various hotel rooms can be coupled to various central stations within the hotel.
Figure 8:
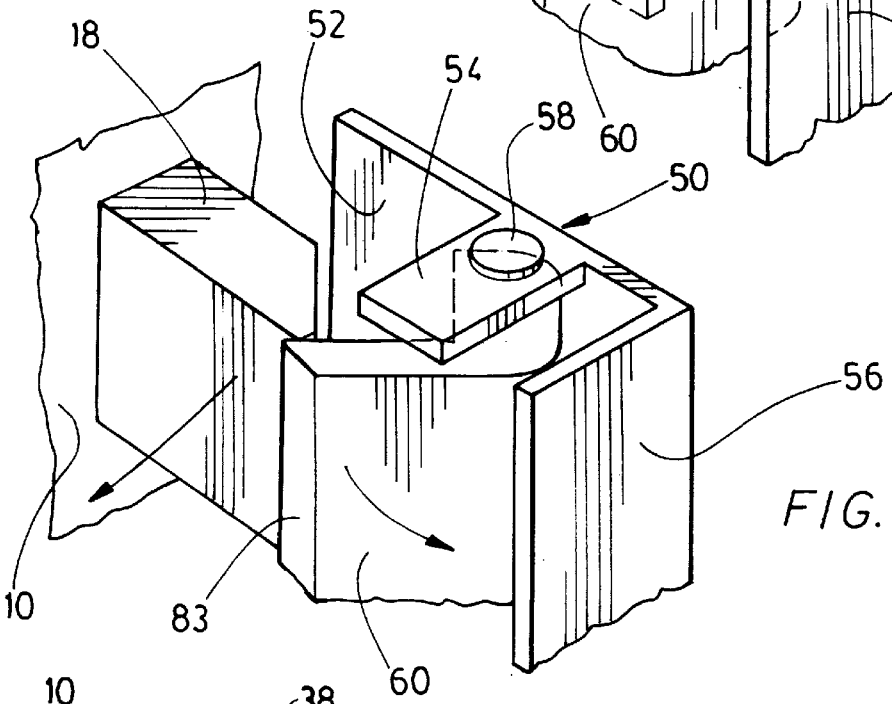
Figure 9:
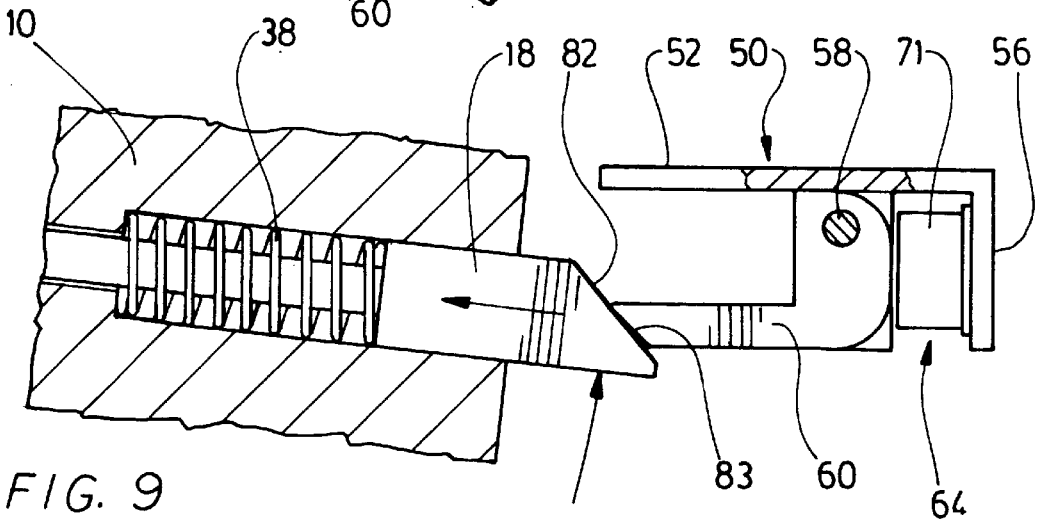

How the latch 18 cooperates with the catch mechanism 28 will be described with reference to FIGS. 7–9. FIG. 7 shows catch mechanism 28 in its locking state and the latch 18 in its locking position retained by the catch 60. The catch mechanism 28 is momentarily placed in its unlocking state by entry of an appropriate code at the keyboard 32. That actuates the solenoid 66 to lower the stop 71 to its unlocking position clear of the catch 60. The door 10 may then be pushed open as in FIG. 8, causing the latch 18 to engage and deflect the catch 60 (through the lateral housing opening 48 as illustrated in FIG. 4). Once the latch 18 clears the catch 60, the biasing springs 62 urge the catch 60 back to its locking position as shown in FIG. 9. As the door 10 once again closes, as shown in FIG. 9, a beveled surface 82 of the latch 18 engages a complementary beveled surface 83 of the catch 60. This forces the latch 18 towards its unlocking position within the door 10, allowing the latch 18 to clear the catch 60. As the door 10 is finally closed, the biasing spring 38 associated with the latch 18 urges the latch 18 through the face plate 42 into its locking orientation between the side plate 52 and catch 60 of the catch assembly, substantially as illustrated in the starting position of FIG. 7. The door 10 is once again locked to the frame 14.

The controller 30 contains a microprocessor 84 and electronic memory 86 (diagrammatically shown in phantom outline in FIG. 1). The memory 86 stores the software algorithm required to implement control functions and also stores authorized access codes that permit entry to the room 12. The microprocessor 84 is programmed to recognize one guest code, several universal codes that are normally assigned on an individual basis to cleaning staff, and several override codes for the hotel manager and security staff. The codes can be entered and altered in a conventional manner with the keyboard 32 by entering appropriate codes instructing editing functions.

The controller 30 has switches that initiate certain control functions and lighting emitting diodes (LED's) that indicate the state of the catch mechanism 28 and the bolt 24. These are apparent in FIGS. 1 and 2. Switch A is intended to be operated by cleaning staff after a guest has departed. Switch B may be operated by a guest to reset the code he uses to enter the room 12. Switch C is essentially a panic button that can be operated by the guest in response to an emergency within the room 12. A green LED 88 on the keyboard 32 indicates when the catch mechanism 28 is in its unlocking state. A red LED 90 on the keyboard 32 indicates when the catch mechanism 28 is in its locking state. A yellow LED 92 indicates whether the bolt 24 is in its locking position, essentially indicating a request by the guest not to be disturbed.

Figure 11:
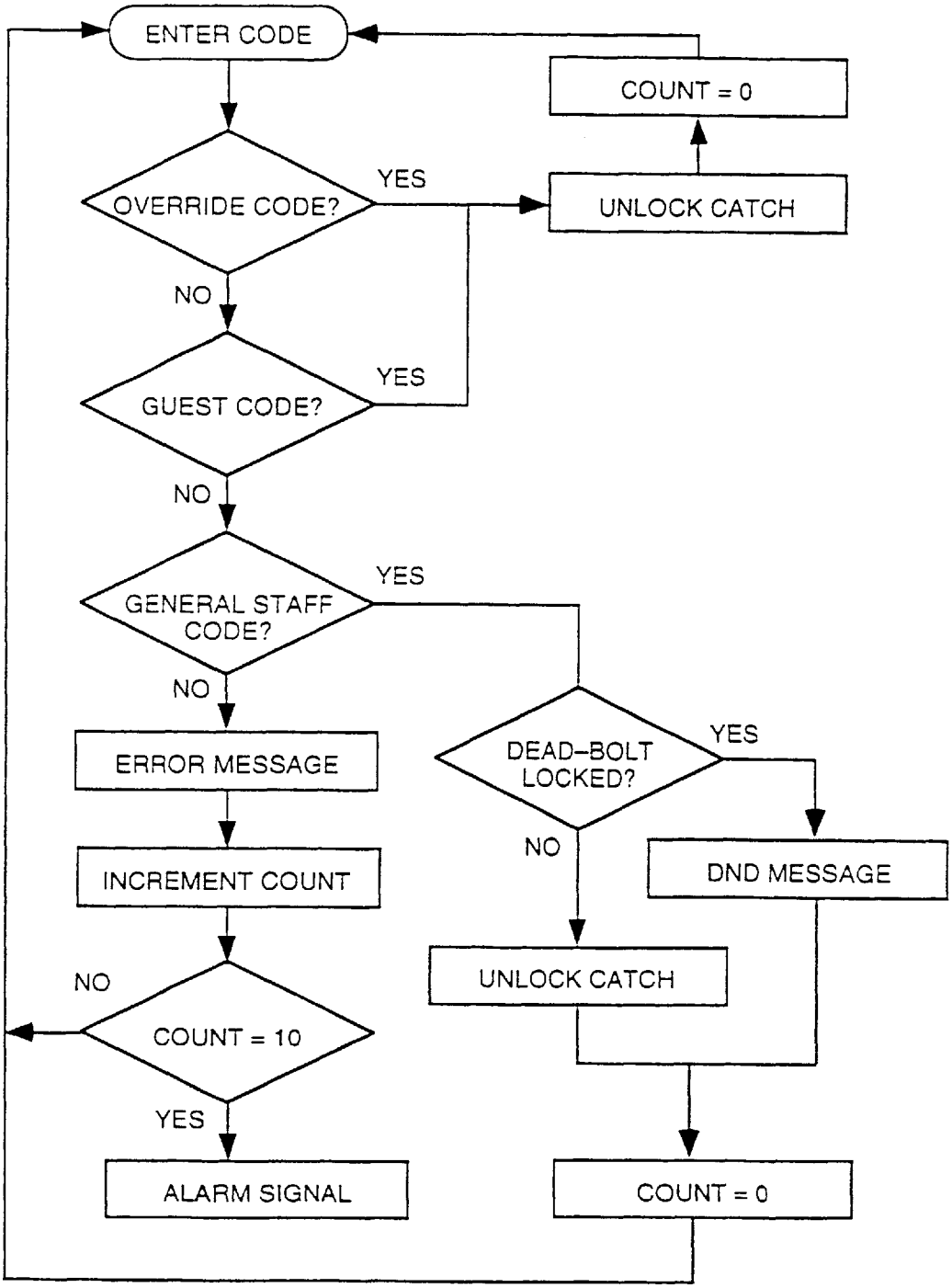
FIG. 11 is a flow chart showing the principal steps of the algorithm normally regulating access to the room.

The controller 30 controls normal access to the room 12 according to the algorithm shown in FIG. 11. In the normal access control mode, the controller 30 responds both to codes entered at the keyboard 32 and to the switch 76 that indicates the state of the bolt 24. Three different aspects of access control will be discussed below, all three being implemented by the algorithm of FIG. 11.

A guest arriving at the hotel is assigned a unique code that corresponds to the current guest code stored in the memory 86. The guest enters the code at the keyboard 32, and the microprocessor 84 compares the entered code with authorized access codes stored in memory 86. If the entered code is not authorized (not stored), the microprocessor 84 gives an appropriate error indication on the display 36 and the red LED 90 is momentarily activated, indicating the door 10 cannot be opened. Otherwise, the controller 30 causes the catch mechanism 28 to momentarily assume its unlocking state and momentarily activates the green LED 88 to indicate that the door 10 is now unlocked. The guest can then push the door 10 open and enter the room 12. The microprocessor 84 deactivates the solenoid 66, restoring the catch mechanism 28 to its locking state, and activates the red LED 90. The latch 18 automatically locks the door 10 to the frame 14 when the guest closes the door 10. The state of the bolt 24 is ignored in response to entry of an authorized guest code so that guest may enter regardless whether another guest within the room has locked the bolt.

It will be noted in the algorithm of FIG. 11 that continual errors in code entry generate an alarm signal. Basically, a count is maintained by the microprocessor 84 of consecutive errors occurring during code entry. An error of course corresponds to absence of an entered code among stored access codes. Each time an error occurs, the count is incremented. Each time an entered code is recognized, the count is set to 0. If the count reaches a preset limit, such as 10, the microprocessor 84 locks the system actuates the speaker 93. This arrangement recognizes that individuals with proper access codes may make entry errors, but prevents an intruder from entering random codes repeatedly in an attempt to obtain access. In an implementation discussed below, where controllers associated with each room in a hotel are coupled to central stations, the alarm signal can be transmitted together with a room identification code to a security station for immediate response.

A member of the hotel staff may enter his personal code at the keyboard 32. The microprocessor 84 scans the stored list of authorized access codes. If the code is not authorized, an error is indicated on the display 36. If the code has been stored and flagged as an override code, assigned for example to the hotel manager or security staff, then the catch mechanism 28 is placed in an unlocking state. If the code has been stored and flagged as a universal code assigned, for example, to a cleaner, the microprocessor 84 checks the state of the bolt 24 as indicated by the switch 76. If the bolt 24 is in its unlocking position, the controller 30 places the catch mechanism 28 in its unlocking state, allowing the staff member to push to door 10 open. If the bolt 24 is locked, the microprocessor 84 leaves the catch mechanism 28 in its locking state and places a corresponding message on the display 36 indicating that the room 12 is occupied. The controller 30 illuminates the yellow LED 92 in response to locking of the bolt 24, to give a visual indication that the room 12 is occupied. As hotel operators can attest, a common and serious complaint among guests is unwanted intrusion by hotel cleaning staff. Cleaning staff may not notice the actuated yellow LED 92 or any other visual indicator, and the controller 30 should thus positively preclude entry by appropriate locking of the catch mechanism 28. The microprocessor 84 may also be programmed to preclude entry of cleaning staff during particular hours of the day, for security reasons.

Figure 10:
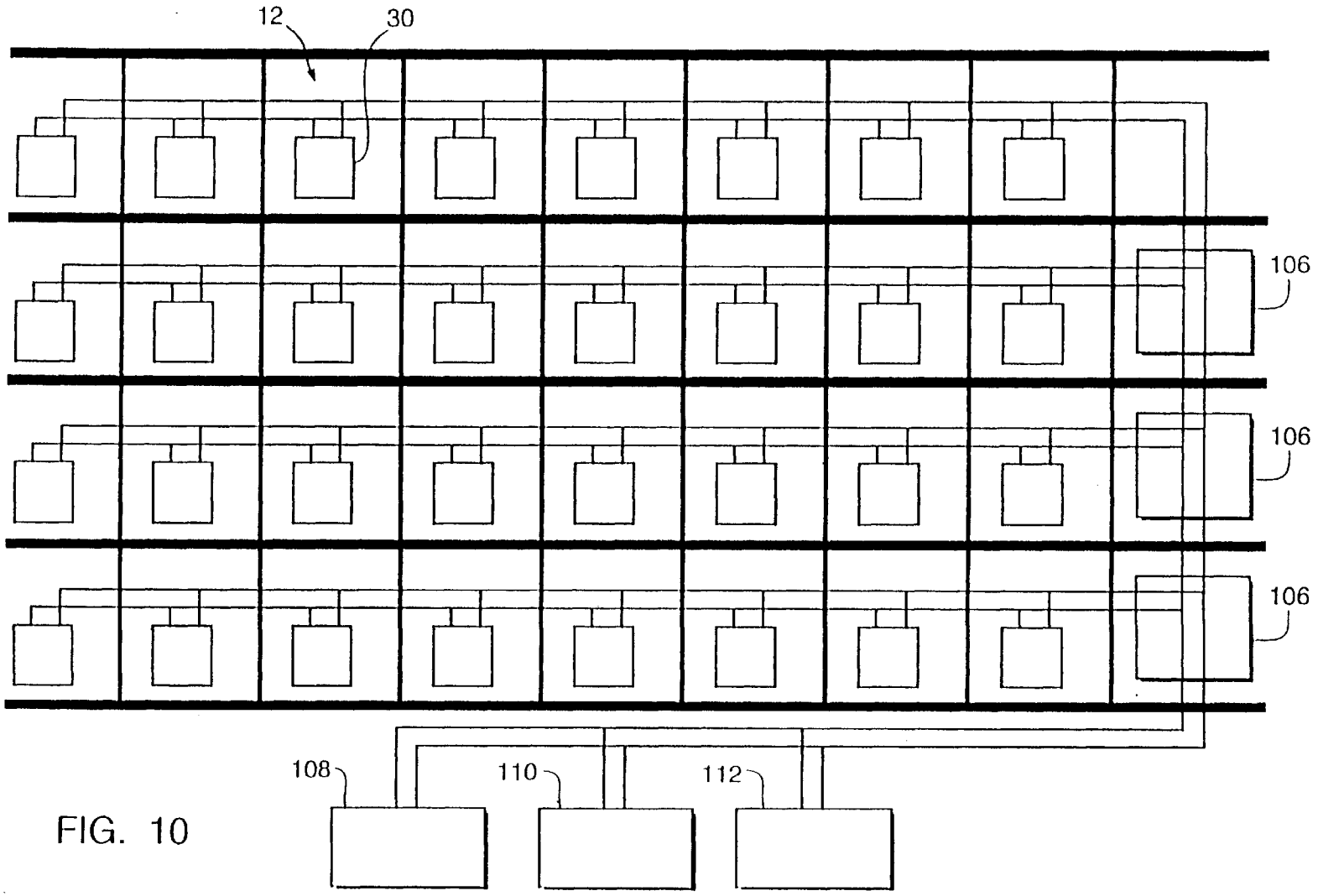

Switch A permits cleaning staff effectively to reset the guest code. The microprocessor 84 responds according to a predetermined algorithm to set a new code. The front desk of the hotel must be notified by the cleaning staff to ensure that an updated code is thereafter assigned to a new guest. If the system illustrated in FIG. 10 is implemented, records of the front desk can be automatically updated and a new code automatically assigned. To prevent inadvertent erasure of a guest's access code, the microprocessor 84 is programmed to respond to entry of a particular universal code, such as the access code used by the cleaning staff, followed by actuation of the switch A (before entry of another code such as the guest's access code).

Switch B allows a guest to change his assigned access code. One problem is that a guest may not remember an arbitrary code. This can lead to repeated requests at the front desk of the hotel to retrieve forgotten codes. Another consideration is guest security. By changing the assigned guest code, the guest is assured that no one else has obtained his code.

In this embodiment of the invention, the guest pushes button B to set the controller 30 to a code-changing mode. The guest is then prompted by the display 36 to enter a new access code at the keyboard 32. Once the new code is entered, the guest is prompted at the display to confirm or cancel the new code, for example, by pressing an enter key on the keyboard 32. If the new code is confirmed, the microprocessor 84 erases the old access code from the memory 86 and records the newly-entered code as the only access code authorized to the guest. This allows a guest to use a license plate number, a social security code, a birth date or any other personal information to control access to his room 12. The button B is of course within the room so that individuals who are not authorized to enter the room cannot initiate the code-hanging function. To avoid inadvertent tripping of the button B by persons with authorized access codes other than the guest, the microprocessor 84 is programmed to enter its code-changing mode of operation in response to entry of the currently-stored guest code followed by tripping of the switch B (before entry of another access code).

The switch C may be used in the event of an emergency. Its function is preferably duplicated by a parallel switch at bedside. In response to operation of the switch C, the microprocessor 84 actuates a speaker 93 mounted on the keyboard 32 to produce an audible alarm signal in the hallway. (The speaker 93 is preferably concealed behind the keyboard 32, but has not been illustrated in that configuration.) The microprocessor 84 simultaneously places the catch mechanism 28 in its unlocking state on a continuous basis. Security staff or anyone passing in the hallway can then enter the room 12 to investigate or lend assistance. Since the catch mechanism 28 releases the bolt 24 as well as the latch 18, it is inconsequential whether the bolt 24 has been set.

A manual override is provided in the event of system failure. It includes a high-security rotary lock mechanism 94 that operated with a special key 96. The mechanism 94 is conventional and displaces a vertical member 98 upwardly and downwardly when operated with the key 96. A forked portion 100 of the member 98 is locates about the shaft 70 of the solenoid 66 and bears against an enlarged head 102 terminating a lower end of the shaft 70. When key 96 is rotated in one direction, the fork 100 is lowered and draws the shaft 70 of the solenoid 66 down, moving the stop 71 to its lower unlocking position (substantially as shown in FIG. 5 when the solenoid 66 is electrically actuated). The door 10 can then be pushed open. The fork 100 also engages and closes a switch 104 within the housing 40. The switch 104 is coupled to the microprocessor 84 so that the occurrence of a manual override is recorded within memory 86. A complete history of access to the room 12 may be kept in the memory 86 for later retrieval, if required. When the key 96 is rotated in an opposite direction, the fork 100 is raised and the stop 71 is restored by the biasing spring 74 to its upper locking position.

FIG. 10 shows schematically how access to multiple rooms in a hotel can be controlled and monitored from central locations. FIG. 10 shows four floors of the hotel. The room 12 and controller 30 described above have been specifically indicated, arbitrarily at a fourth floor. Others rooms and their associated controllers have been identically illustrated but have not been specifically indicated with reference numerals. The door frame of each room is fitted with a controllable catch mechanism as described above and each is controlled with a keyboard wall-mounted just outside the room. Routers 106 in hallways may be used to control signal transmission to and from three central stations 108, 110, 112 which have appropriate processors (not separately illustrated). The stations 108, 110, 112 may be the front desk where guests are issued room codes, the housekeeping department, and the security department. All are coupled by wiring 114 which is embedded within the walls of the hotel structure. This arrangement is made practical because the catch mechanisms and controllers are wall-mounted and wiring to doors themselves is avoided.

The arrangement shown in FIG. 10 implements several functions which will be described with reference to the room 12. In response to operation of the switch A, the microprocessor 84 updates the guest access code for room 12, and transmits the room number, new guest access code, and a signal indicating availability of the room. The processing unit at the front desk 108 records that the room is available for a new patron and records the new guest access code. In an alternative implementation, the microprocessor 84 transmits only the room number and the signal indicating availability. The processing unit at the front desk then responds by generating and transmitting a new guest access code which the microprocessor 84 then stores as its current authorized guest code. In response to operation of switch A, the microprocessor 84 transmits to another processing unit in a housekeeping department 110 the room number and availability signal, and the processing unit of the housekeeping department 110 updates a list of rooms cleaned and requiring cleaning.

In response to operation of switch C, the microprocessor 84 transmits both the room number and an alarm signal to the processing unit at the front desk 108 and to a processing unit at the security department 112. The processing units then indicate an alarm state in room 12 at both locations on monitors and by actuating a speaker.

The arrangement permits another significant function to be implemented. In the event of fire, the processing unit at the front desk 108 or at the security department 112 is operated to transmit to the controllers of all rooms a global alarm signal. The controller 34 responds by placing the catch mechanism 28 continually in an unlocking state. Other controllers release the catch mechanisms associated with their rooms. This allow security staff to promptly check rooms and ensure proper evacuation of the building.

Figure 12:
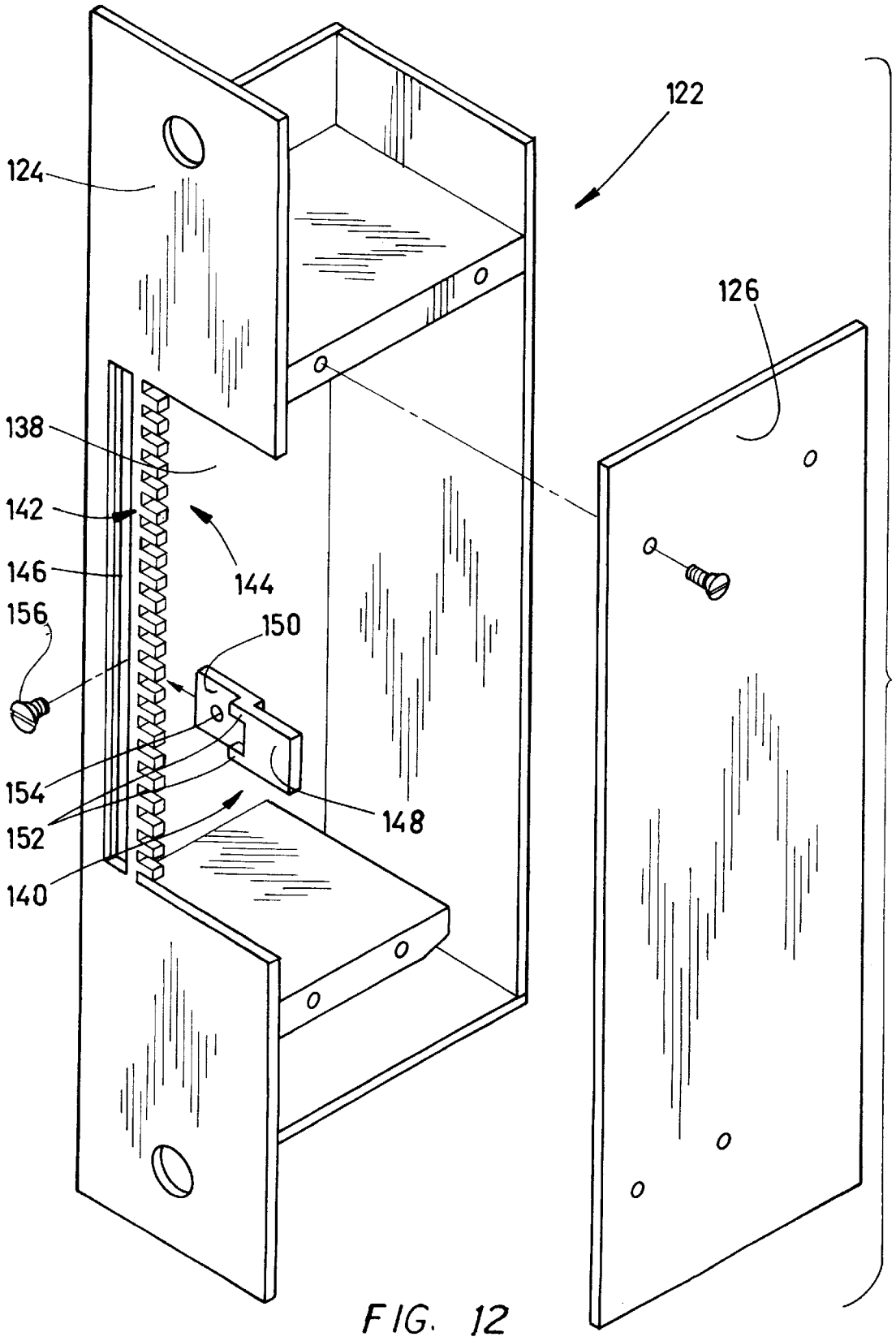
FIG. 12 is an exploded view of a housing associated with a second catch mechanism.
Figure 13:
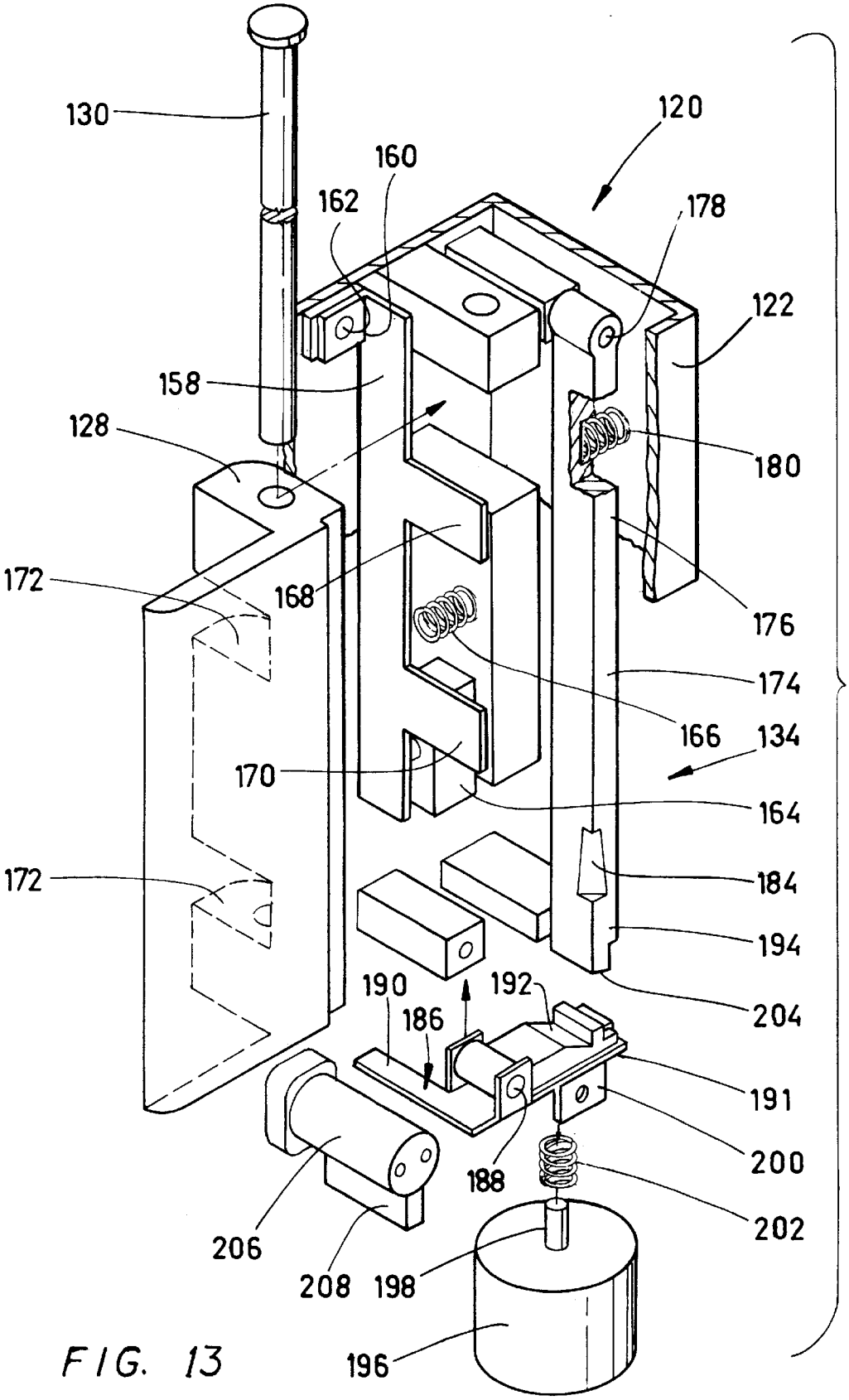
FIG. 13 is an exploded perspective of the second catch mechanism.
Figure 17:
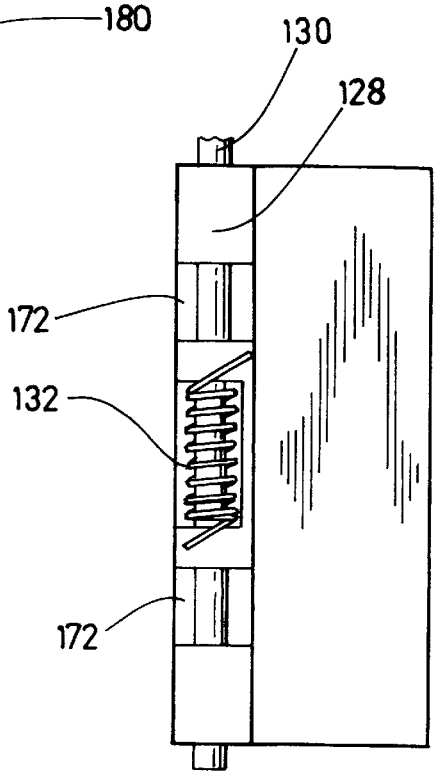
FIG. 17 is side elevation of the catch associated with the second catch mechanism.

Reference is made to FIGS. 12 and 13 which show an alternative catch mechanism 120 that can be used with the controller 30. The catch mechanism 120 comprises a narrow steel housing 122 that can be installed within the door frame 14 (installation not shown). The housing 122 includes a face plate 124 and detachable side plate 126. The housing 122 contains a generally L-shaped catch 128 that once again engages the latch 18 and bolt 24 in their locking positions within the frame 14. The catch 128 is supported by a vertical pin 130 for pivoting between locking and unlocking positions. A coil spring 132 (apparent in FIG. 17) urges the catch 128 towards its locking position within the housing 122. A stop mechanism 134 secures the catch 128 in its locking position until an appropriate access code is received by the controller 30. The catch mechanism 120 is similar in overall operation to the catch mechanism 28 above, and the description below will focus primarily on differences between the two mechanisms 28, 120.

Figure 14:
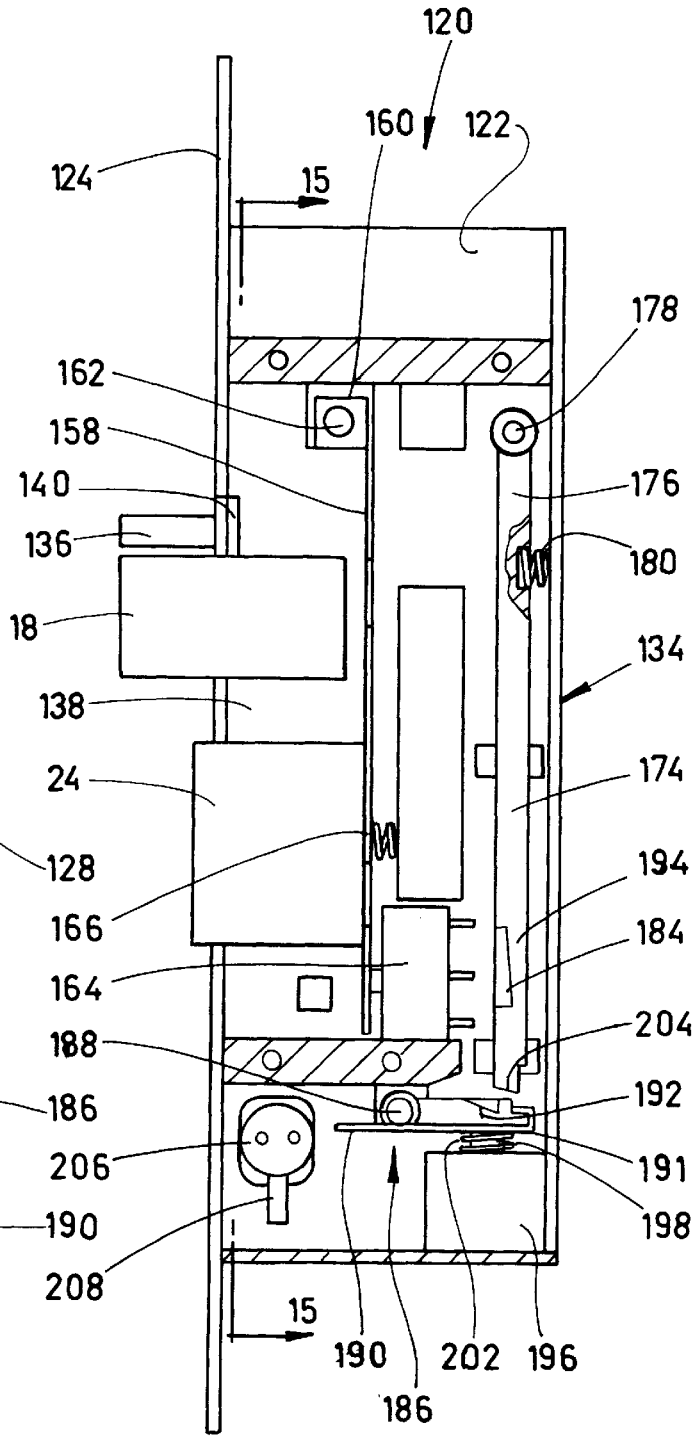
FIG. 14 is a plan view in partial cross-section of the second catch mechanism.
Figure 16:
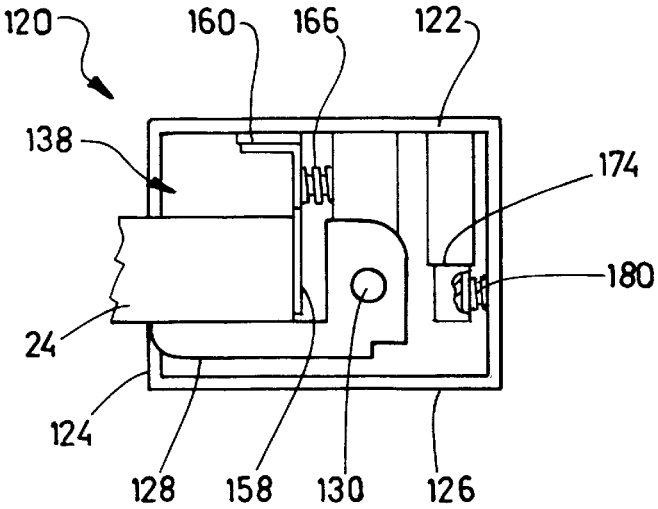
FIG. 16 is plan view in a horizontal plane through the housing of the second catch mechanism showing relative positioning of various components of the second catch mechanism.

A security pin 136 associated with the latch mechanism 16 has been shown in FIG. 14. The security pin 136 prevents the latch 18 from being defeated by application of forces to the latch 18 from externally of the door 10. In a conventional manner, the security pin 136 is spring-biased to extend from the door 10 toward the frame 14, and may be beveled (not apparent) much like the latch 18 to retract partially as the door 10 closes. If, for example, a credit card is inserted between the door 10 and the frame 14 to attempt to retract the latch 18, the security pin 136 is simultaneously displaced into the door 10 and disables displacement of the latch 18 to its unlocking position. The security pin 136 retracts into the door 10 when the latch actuator 26 is operated to retract the latch 18. For proper operation, the security pin 136 must normally engage the face plate 124 when the door 10 is closed and cannot be allowed to enter into the frame 14.

The catch mechanism 120 does not require a custom-made face plate to accommodate the exact location of the latch 18, dead bolt 24, and security pin 136 of the latch mechanism 16. The face plate 124 has a single vertical opening 138 that receives both the latch 18 and bolt 24, as apparent in FIGS. 12 and 13, rather than individual openings separately receiving the latch 18 and bolt 24. The face plate 124 also carries a stop 140 that engages the security pin 136. The face plate 124 is adapted to receive the stop 140 at various selectable vertical positions. To that end, the face plate 124 comprises an elongate vertical track 142 formed with regularly spaced horizontal teeth 144 that extend into the vertical opening 138, and an elongate vertical slot 146 parallel to the track 142 and inset from the edge of the opening 138. The stop 140 has an abutment section 148 and tab 150 offset from the abutment 148. The tab 150 is inserted behind the face plate 124. It has a pair of mounting blocks 152 dimensioned and spaced to locate between the teeth 144, and a threaded aperture 154 that aligns with the slot 146. A screw t56 is inserted through the slot 146 and into the threaded aperture 154 to fasten the stop 140 to the face plate 124 with the abutment section 148 extending horizontally into the vertical opening 138 in the path of the security pin 136. During installation, the housing 122 is simply positioned in the door frame 14 such that both the latch 18 and bolt 24 can extend into the vertical opening 138. The stop 140 may then be appropriately positioned along the track 142 to engage the security pin 136. This arrangement eliminates the need for precise vertical positioning of the catch mechanism 120 and the need for a custom-made face plate in most applications.

Figure 15:
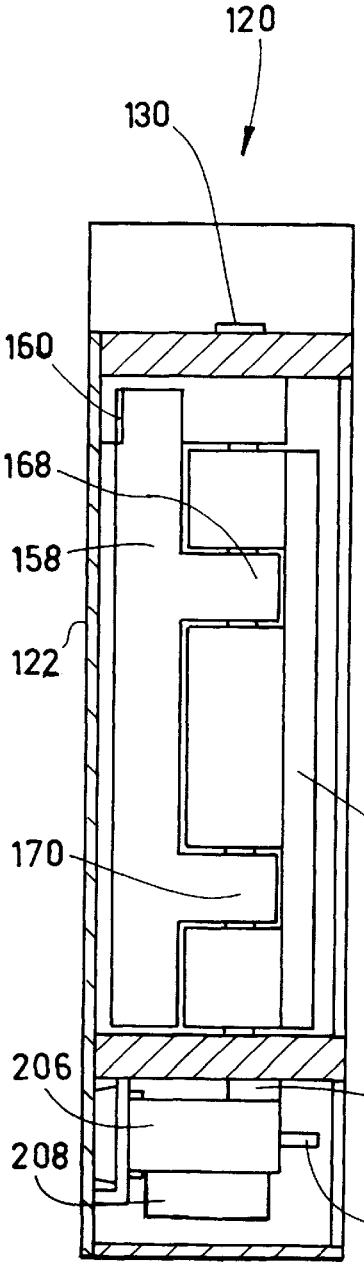
FIG. 15 is a view along lines 15—15 of FIG. 14.

The state of the dead bolt 24 is also sensed in a manner less dependent on relative positioning of the latch 18 and bolt 24. To that end, a generally vertical sensing plate 158 is located within the housing 122 (as most apparent in FIGS. 13–15). An upper end of the plate 158 has an angled tab 160 that receives a horizontal pivot pin 162 fixed to the housing 122. The pin 162 permits the plate 158 to pivot between a rest position proximate to the opening 138 and a displaced position further away from the opening 138 in which the bottom of the plate 158 operatively engages a switch 164 positioned rearward of the catch 128. A coil spring 166 urges the plate 158 forward toward the vertical opening 138 and away from the switch 164. The plate 158 is positioned horizontally to one side of the catch 128 to allow pivoting movement, but comprises a pair of upper and lower horizontal arms 168, 170 that overlay respectively the upper and lower halves of the vertical opening 138 in horizontally space relationship thereto. The vertical spacing of the arms 168, 170 accommodates mounting of the bolt 24 either above or below the latch 18, and one of the arms 168, 170 will normally be positioned for engagement with the bolt 24. Upper and lower clearance openings 172 are formed in the rear section of the catch 128 to accommodate rearward pivoting of the arms 168, 170. In this particular application, when the bolt 24 is advanced, substantially through the lower half of the opening 138, to its locking state within the catch mechanism 120, it engages the lower arm 170 and deflects the plate 158 rearward. The switch 164 is then tripped and indicates the locking state of the bolt 24. The sensing plate 158 has distinct upper and lower arms 168, 170 which overlay the upper and lower halves of the opening 138, but have a surface area smaller than the overlaid halves of the opening 138. In other embodiments, a sensing plate or member which conforms to the shape and area of the opening and which does not have distinct and completely separate upper and lower portions.

The stop mechanism 134 is particularly suited for use in a narrow housing. Details are most apparent in FIG. 16–19. It comprises an elongate generally vertical stop member 174 which is positioned rearward of the catch 128. The stop member 174 has an upper end 176 mounted with a horizontal pivot pin 178 to the housing 122. A coil spring 180 urges the stop member 174 forward to a locking position against the back of the catch 128 where a rearward projection 182 from the catch 128 engages a smoothly curved recess 184 in the stop member 174. A catcher 186 is mounted with a horizontal pivot pin 188 to the housing 122, immediately below the lower end of the stop member 194. The pivot joint is formed intermediate forward and rear arms of the catcher 190,191. The rear arm 191 is formed with a notch 192 shaped to receive and retain the lower end of the stop member 194. A solenoid 196 has a vertical shaft 198 connected in a pivoting manner (not shown) to an apertured tab 200 extending downwardly from the rear arm of the catcher 191. When electrically actuated, the solenoid 196 pivots the rear arms 191 downwardly, releasing the stop member 174. This allows the catch 128 to pivot to its unlocking position. In response to opening of the door 10, the rearward projection on the catch 182 simply deflects the stop member 174. The rear arm of the catcher 191 is otherwise urged upwardly into engagement with the lower end of the stop member 194 by a coil spring 202 mounted around the shaft of the solenoid 198. A beveled lower surface on the stop member 204 ensures that the lower end of the stop member 194 returns under the influence of its biasing spring 180 to a locking position retained within the notch of the catcher 192. Thus, when the catch 128 pivots back to its locking position after the opening of the door 10, the stop member 174 immediately engages the catch 128 and the catcher 186 immediately secures the stop member 174 in a locking position against the rear of the catch 128.

Figure 18:
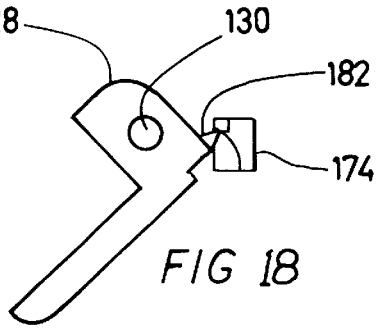
FIG. 18 is a view from above showing how the catch deflects a stop member.
Figure 19:
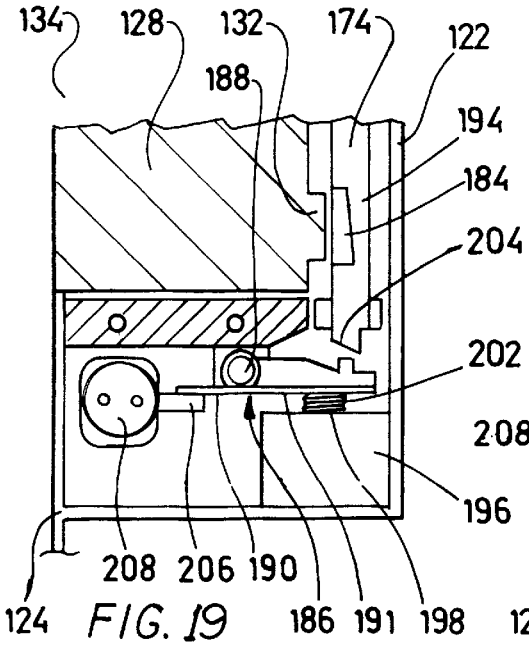
FIGS. 19 and 20 are fragmented side elevations in partial cross-section showing showing a catcher securing and releasing the stop member.
Figure 20:
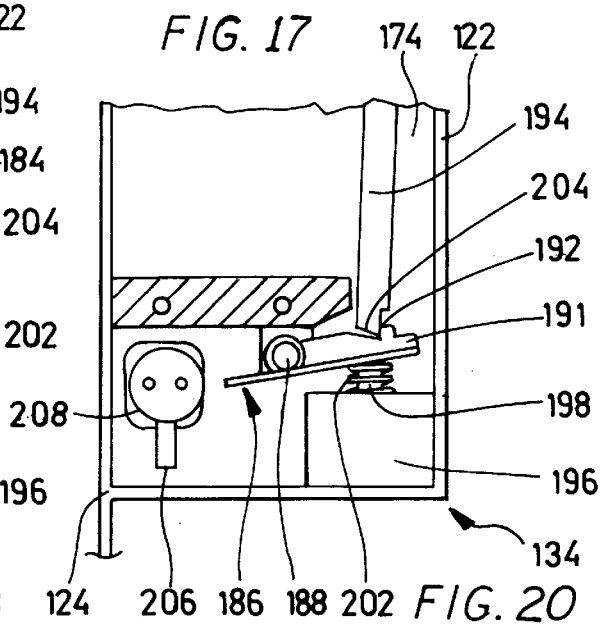

A manual override is once again provided in the event of an equipment failure, as apparent in FIGS. 18 and 19. It includes a conventional high-security rotary lock mechanism 206 that carries an arm 208. Operation of the lock mechanism 206 with an appropriate key from externally of the room causes the arm 208 to rotate into engagement with the forward arm of the catch 190 thereby pivoting the rear arm 191 downwardly and freeing the lower end of the stop member 194.

Figure 21:
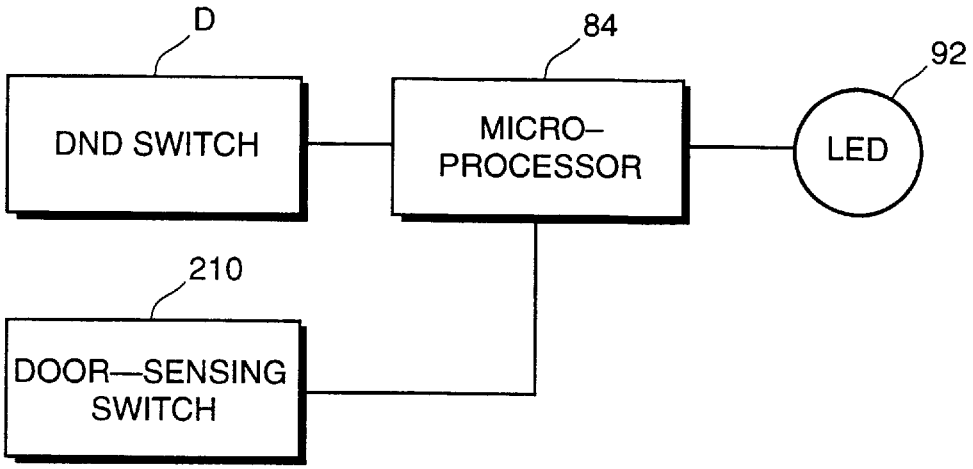
FIG. 21 diagrammatically illustrates how a manually-operated switch can be used to set a privacy requirement and effectively restrict access to the room.

In the embodiments above, a condition corresponding to or indicating a request for privacy is set by throwing the bolt 24 to its locking position. The position of the bolt 24 is sensed and signalled to the microprocessor 84 by tripping sensing switches 76, 80 or switch 164. An alternative arrangement for setting the condition is shown diagrammatically in FIG. 21. The switches and components required to sense the position of the bolt 24 are eliminated. Instead, the controller 30 may be provided with a manually-operable switch D, which may be positioned adjacent the switches A–C and appropriately labelled "DND" (Do Not Disturb). The microprocessor 84 is programmed to respond to actuation of the switch D by recognizing and effectively maintaining a privacy condition and actuating the yellow LED 92 to indicate the privacy request to cleaning staff, externally of the room 12. The condition may be reset (cancelled or nulled) by actuating the switch D again, in which case the mnicroprocessor 84 extinguishes the LED 92. To ensure that the condition is reset when a guest leaves the room, a sensor 210 is mounted within the housing 40 or 122 to sense when the door 10 is opened. The sensor 210 may be a spring-biased pin (not illustrated) that extends through the face plate associated with the housing 40 or 122 to engage an edge of the door 10 and a switch (not illustrated) tripped by displacement of the pin into the housing 40 or 122 by the door 10. Sensors for detecting the open and closed states of a door are well known in the security arts, and any appropriate sensor may be used. When the microprocessor 84 is signaled by the sensor 210 that the door has been opened, the microprocessor 84 effectively resets the privacy condition to a null state and extinguishes the yellow LED 40. Access in response to codes assigned to cleaning staff and security staff is otherwise controlled as described above, access to cleaning staff being refuse while the privacy condition continues.

Figure 22:
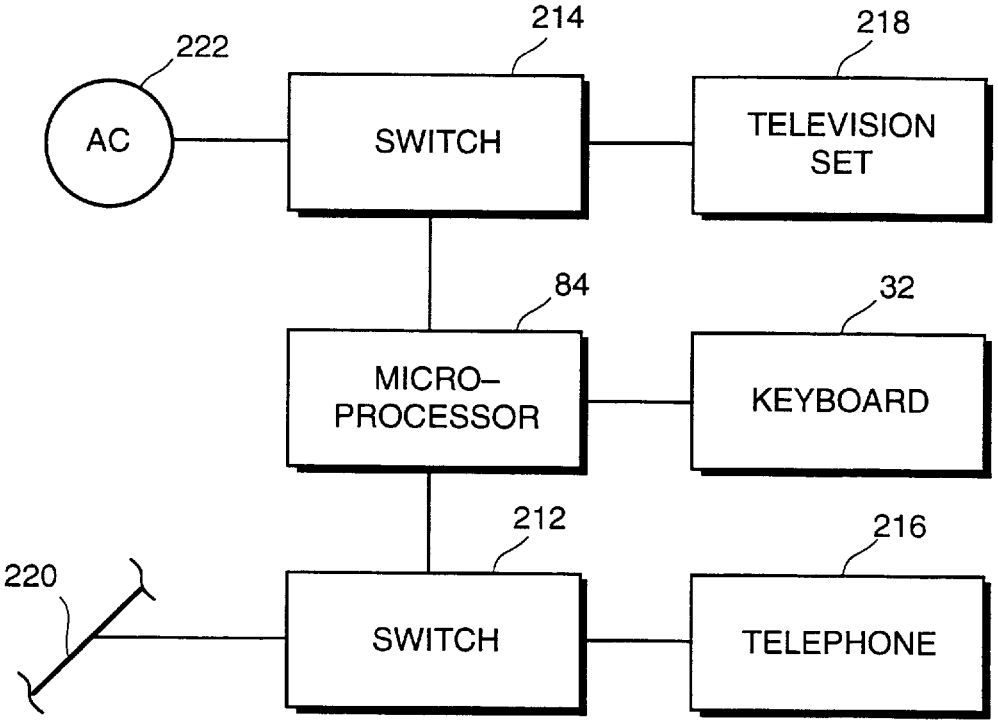
FIG. 22 diagrammatically illustrates an arrangement in which electrically-operated equipment within the room is controlled in response to access codes.
Figure 25:
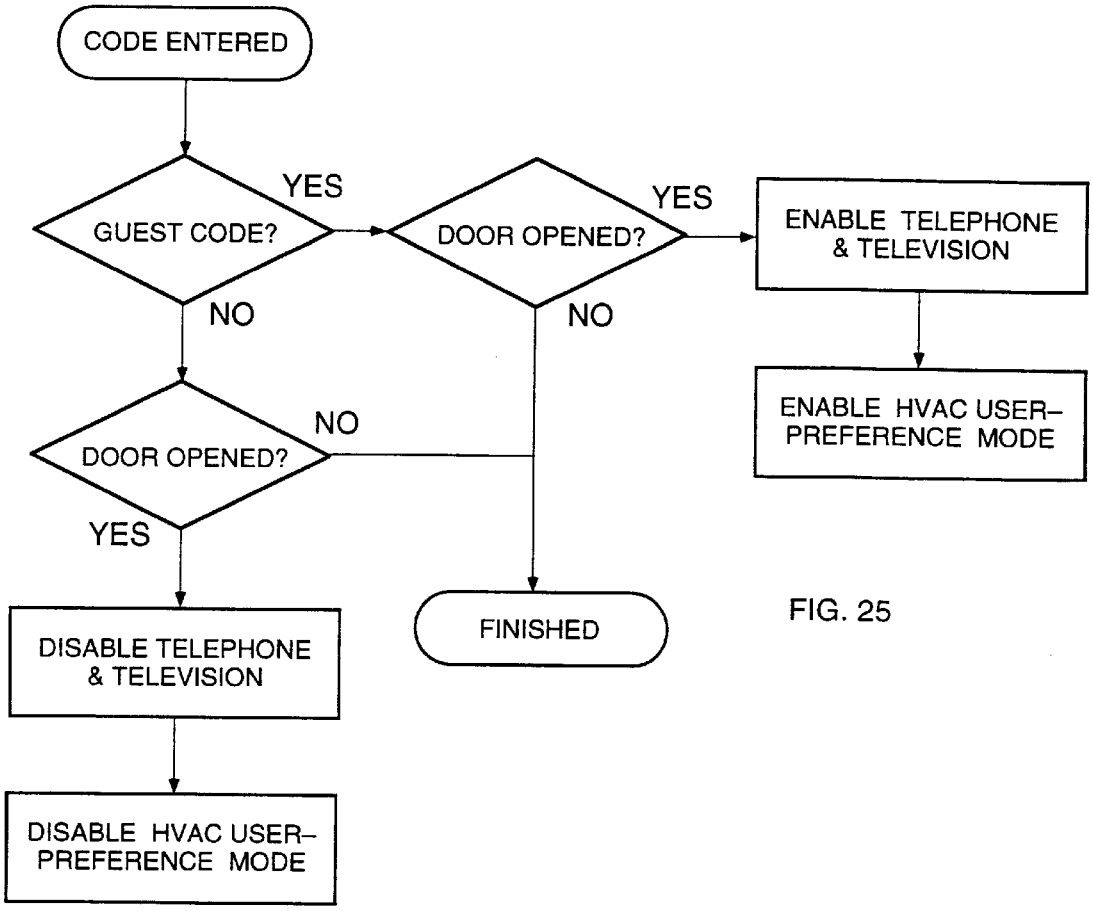

The controller 30 may optionally control the operation of electrically operated equipment within the room 12 in response to access codes composed at the keyboard 32. Such an arrangement will be described with reference to FIG. 22 which shows the microprocessor 84 coupled through switches 212, 214 to a telephone 216 and a television 218 and FIG. 25 which illustrates additional process steps implemented by the microprocessor 84 in response to entry of access codes. The switch 212 may simply be wall-mounted behind a telephone jack (not shown) and may couple and decouple the telephone 216 to and from a telephone line 220. The switch 214 may be mounted within an electrical outlet and may couple and decouple the television set to and from an AC main 222. As apparent in the flow chart of FIG. 25, if the currently assigned guest code is composed at the keyboard 32, and if the door 10 is opened as indicated by the sensor switch 210, then the microprocessor 84 trips the switches 212, 214 to enable operation of the telephone 216 and television set 218. If any other access code is entered, such as a code assigned to cleaning staff, and if the door 10 is opened, the microprocessor 84 trips the switches to disable the telephone 216 and television set 218. The sensing of the opening of the door 10, particularly in response to composition of a non-guest code, reduces the likelihood that equipment within the room 12 will be toggled between operative and inoperative states if cleaning staff, for example, enter a valid code but entry is refused in response to a DND condition set by a guest within the room 12. The overall arrangement ensures that cleaning staff are not engaged in local calls or watching television programs, rather than working, which appears to be a problem in the hotel industry.

Figure 23:
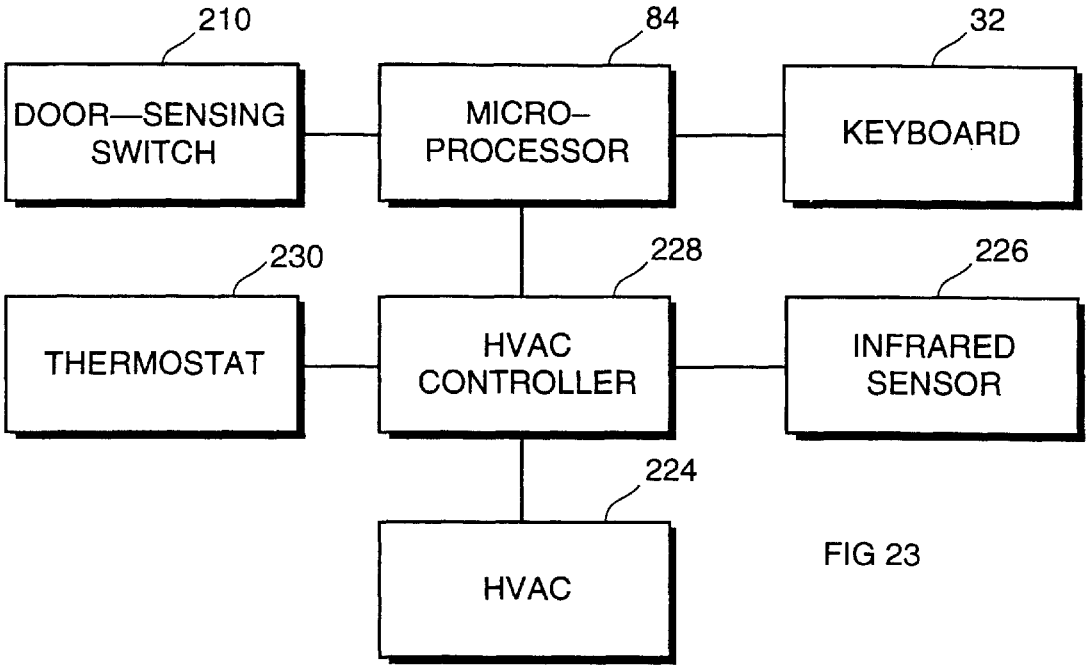
FIG. 23 diagrammatically illustrates an arrangement in which the access control system is adapted to control operation of an HVAC in response to access codes.

The controller 30 may optionally control the operation of temperature-controlling equipment associated with the room 12 in response to access codes. An exemplary arrangement is shown in FIG. 23. An HVAC 224 may be operated in a known manner in response to an infrared sensor 226 that detects the presence or absence of a guest in the room 12 and to a conventional thermostat 230 that allows a user to set his temperature preferences. In response to sensed presence of a person, an HVAC controller 228 responds to the thermostat 230, by adjusting room temperature to reflect the user preferences. If the room 12 is empty, the controller 228 implements pre-programmed temperature requirements that minimize energy consumption (relatively cold in winter and relatively hot in summer). The microprocessor 84 is programmed to override operation of the controller 228, specifically to override its mode switching, in response to access codes. The additional process steps implemented by the microprocessor 84 are illustrated in the flow chart of FIG. 25. If a code other than a guest code is composed at the keyboard 32, the microprocessor 84 effectively maintains the temperature limits set for energy conservation, basically leaving the controller 228 in its energy-conserving mode of operation. If the guest access code is entered and if the door-sensing switch 210 indicates that the door 10 has been opened (suggesting that the guest is actually entering the room ), the microprocessor 84 allows the normal operation of the controller 228, effectively restoring a user-preference mode of operation in which user-set temperature requirements are observed.

Figure 24:
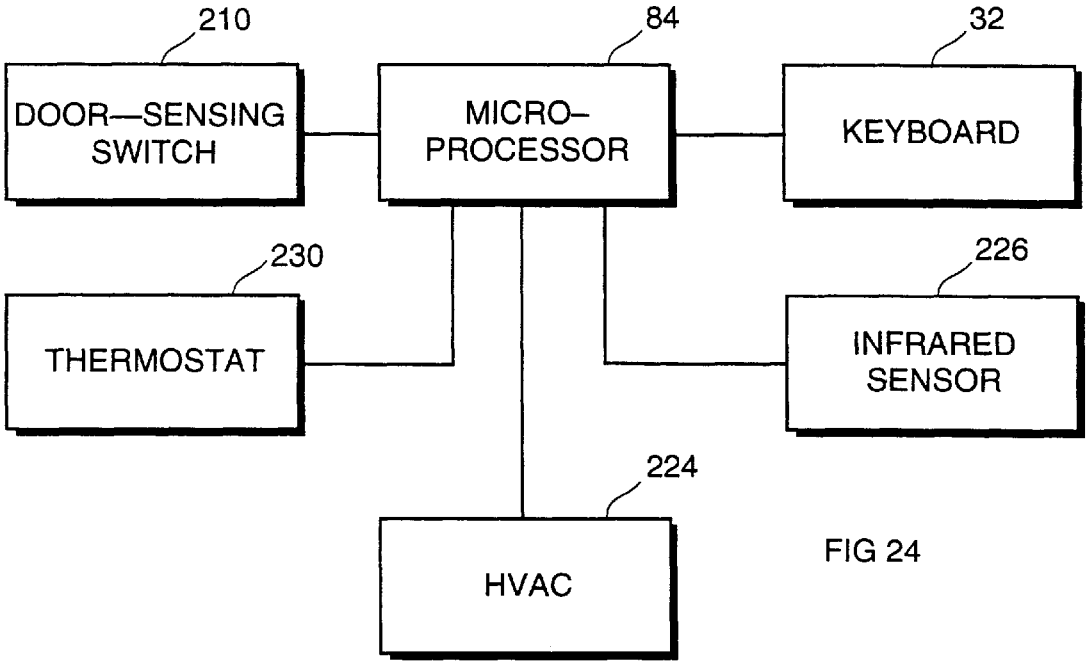
FIG. 24 diagrammatically illustrates an arrangement in which the HVAC is controlled directly by the access control system in response to access codes, user-preferred and energy-conserving temperature set points, and presence of a person in the room; and, FIG. 25 is a flow chart illustrating process steps involved in controlling operation of the electrical equipment of FIG. 22 and the HVAC of FIG. 23.

If the HVAC 224 has not been adapted for energy-conservation and user-preference modes of operation, but simply responds directly to user preferences set with the thermostat 230, the microprocessor 84 can be programmed to adapt operation of the HVAC 224 for energy conservation. Such an arrangement is illustrated in FIG. 24 where the existing thermostat 230 is now coupled to the microprocessor 84. The infrared sensor 226 is installed and coupled to the microprocessor 84, and the microprocessor 84 is coupled to the HVAC 224, through appropriate interfaces, the microprocessor effectively applying to the HVAC 224 the same type of triggering signals otherwise applied by the thermostat 230. The microprocessor 84 may be programmed in a conventional manner to receive energy-conserving temperature set points entered at the keyboard following entry of an appropriate service code, and programmed in a conventional manner to implement energy-conserving and user-preference modes of operation in response to presence or absence of a person and, as described above, in response to composition of access codes and the sensed state of the door 10.

It will be appreciated that particular embodiments of the invention have been described and illustrated and that modifications may be made therein without necessarily departing from the scope of the appended claims.

I claim:

1. A system which controls access to a room comprising a door that pivots on a frame between open and closed orientations, the door having a latch mechanism comprising a latch displaceable when the door is closed between a locking position within the frame and an unlocking position clear of the frame, a latch actuator manually operable from within the room to displace the latch from its locking position to its unlocking position and means for urging the latch to its locking position, the system further comprising:

catch means mounted within the frame for receiving the latch when advanced to its locking position, the catch means having a locking state in which the catch means engage the received latch to prevent the door from opening and an unlocking state in which the catch means permit the received latch to displace with the door thereby to allow the door to open; and, setting means manually operable from within the room to set a predetermined condition indicating a requirement for privacy; and, control means for controlling the state of the catch means in response to the condition and in response to a plurality of access codes, the control means comprising input means external to the room and proximate to the door for receiving codes, the control means being programmed to respond to receipt of one of the access codes by placing the catch means in the unlocking state regardless whether the condition is set and to respond to receipt of another of the access codes by placing the catch means in the unlocking state only if the condition is not set.

2. The system of claim 1 in which:

the input means comprise a keyboard;

the control means comprise storage means for storing the plurality of access codes; and, the control means comprise a mode of operation triggered in part in response to composition of a predetermined one of the access code at the keyboard in which the control means replace the predetermined one of the access codes in the storage means with a user-selected access code composed at the keyboard, whereby, the control means place the catch means in the unlocking means in response to composition of the user-selected code at the keyboard and cease to place the catch means in the unlocking state in response to the composition of the replaced access code.

3. The system of claim 2 in which:

the control means comprise means for sensing the open and closed orientations of the door; and, the control means respond to the sensing means by resetting the condition in response to opening of the door.

4. The system of claim 1 adapted to control operation of electrically-operated equipment within the room, in which the control means comprise switching means for enabling and disabling operation of the equipment, the control means being programmed to respond to receipt of a predetermined one of the access codes by enabling operation of the equipment and to respond to receipt of another of the access codes by disabling operation the equipment.

5. The system of claim 4 in which the switching means are connected to one of a telephone and television set thereby to enable and disable the one of the telephone and television set.

6. The system of claim 1 adapted to control temperature-adjusting equipment affecting the temperature of the room, the equipment having an energy-conserving mode of operation and a user-preference mode of operation in which the equipment responds to user-set temperature settings, in which the control means are programmed to respond at least in part to receipt of a predetermined one of the access codes by setting the equipment to its user-preference mode of operation and respond to receipt of another of the access codes by leaving the equipment in a current one of its operating modes.

7. The system of claim 6 in which the control mean comprise means for sensing the open and closed orientations of the door and in which the control means are programmed to set the equipment to the user-preference mode of operation in response to receipt of the predetermined one of the access codes and a sensed opening of the door after receipt of the predetermined one of the access codes.

8. The system of claim 1 in which the door comprises a deadbolt mechanism, the deadbolt mechanism comprising a bolt displaceable when the door is closed between a locking position within the frame and an unlocking position clear of the frame, and a bolt actuator located within the room and manually operable to displace the bolt between its locking and unlocking positions, the catch means receiving the bolt when advanced to its locking position, the catch means in the unlocking state engaging the received bolt to prevent the door from opening and the catch means in the unlocking state permitting the received bolt to displace with the door thereby to allow the door to open.

9. The system of claim 8 in which the control means comprise:

a manually-operable alarm switch located within the room; and, alarm means for generating an alarm signal when actuated;

the control means actuating the alarm means to generate the alarm signal and placing the catch means in the unlocking state in response to operation of the alarm switch.

10. The system of claim 1 in which the latch mechanism comprises a security pin which is urged to extend toward the frame when the door is closed and which disables displacement of the latch to its unlocking position when the security pin is pushed toward the door, the catch means comprising:

a housing with an opening for receiving the latch and the bolt when displaced to their locking positions;

a stop for engagement with the security pin; and, means for securing the stop to the housing at various selectable vertically spaced positions in Which the stop extends into the opening.

11. The system of claim 10 in which the means for securing the stop to the housing comprise an elongate track shaped to seat the stop at the various selectable positions.

12. The system of claim 1 in which:

the control means comprise a switch and storage means for storing the access codes; and, the control means are programmed to respond to receipt of a predetermined access code and operation of the switch by removing another predetermined access code from the storage means thereby precluding placing of the catch means in the unlocking state in response to further receipt of the other predetermined access code.

13. Apparatus for controlling access to a room comprising a door that pivots on a frame between open and closed orientations, the door comprising a latch mechanism and a deadbolt mechanism, the latch mechanism comprising a latch displaceable when the door is closed between a locking position within the frame and an unlocking position clear of the frame, a latch actuator manually operable from within the room to displace the latch from its locking position to its unlocking position, means urging the latch to its locking position, a security pin which is urged to extend toward the frame when the door is closed and which disables displacement of the latch to its unlocking position when the security pin is pushed toward the door, the deadbolt mechanism comprising a bolt displaceable when the door is closed between a locking position within the frame and an unlocking position clear of the frame and a bolt actuator manually operable from within the room to displace the bolt between its locking and unlocking positions, the apparatus comprising:

catch means mountable within the frame to receive the latch and the bolt when advanced to their locking positions, the catch means comprising a housing with an opening for receiving both the latch and the bolt, a stop for engagement with the security pin, and means for securing the stop to the housing at various selectable vertically spaced positions in which the stop extends into the opening, the catch means having a locking state in which the catch means engage the received latch and the received bolt to prevent the door from opening and an unlocking state in which the catch means permit the received latch and the received bolt to displace with the door thereby to allow the door to open, the catch means comprising a striking surface positioned to engage a cooperating surface of the latch to displace the latch toward its unlocking orientation as the door is closed thereby to receive the latch within the catch means; and, control means for controlling the state of the catch means in response to a plurality of access codes, the control means comprising input means adapted for location external lo the room for receiving the codes.

14. The apparatus of claim 13 in which the means for securing the stop to the housing comprise an elongate track shaped to seat the stop at the various selectable positions.

* * * * *